US011657735B2

(12) United States Patent
Sabbagh

(10) Patent No.: US 11,657,735 B2
(45) Date of Patent: May 23, 2023

(54) EXTRUDED PROFILE FOR ELECTRONIC SHELF LABEL HOLDER

(71) Applicant: SISMO EXTRUSIONS INC., Dorval (CA)

(72) Inventor: Vincent Sabbagh, Dorval (CA)

(73) Assignee: SISMO EXTRUSIONS INC., Dorval (CA)

( * ) Notice: Subject to any disclaimer, the term of this patent is extended or adjusted under 35 U.S.C. 154(b) by 31 days.

(21) Appl. No.: 17/230,512

(22) Filed: Apr. 14, 2021

(65) Prior Publication Data

US 2021/0319723 A1 Oct. 14, 2021

Related U.S. Application Data

(60) Provisional application No. 63/009,748, filed on Apr. 14, 2020.

(51) Int. Cl.

| | |
|---|---|
| ***G09F 3/20*** | (2006.01) |
| ***G09F 3/16*** | (2006.01) |
| ***A47F 5/00*** | (2006.01) |

(52) U.S. Cl.

CPC ..... *G09F 3/204* (2013.01); *A47F 5/0068* (2013.01); *G09F 3/16* (2013.01); *G09F 3/208* (2013.01)

(58) Field of Classification Search

CPC . G09F 3/204; G09F 3/16; G09F 3/208; A47F 5/0068

See application file for complete search history.

(56) References Cited

U.S. PATENT DOCUMENTS

| | | | | |
|---|---|---|---|---|
| 5,816,550 | A | 10/1998 | Watanebe et al. | |
| 6,126,125 | A * | 10/2000 | Dalton | G09F 3/204 248/205.2 |
| 6,367,752 | B1 * | 4/2002 | Forsythe | G09F 3/204 248/220.21 |
| 6,935,061 | B2 | 8/2005 | Thompson | |
| 10,706,749 | B1 * | 7/2020 | White | G09F 3/204 |
| 2005/0035075 | A1 | 2/2005 | Walker | |
| 2005/0166438 | A1 * | 8/2005 | Mueller | G09F 3/204 40/661.03 |
| 2008/0282592 | A1 * | 11/2008 | Brinkman | G09F 3/204 40/649 |
| 2009/0056190 | A1 * | 3/2009 | Mueller | G09F 3/204 40/661.03 |
| 2014/0158846 | A1 * | 6/2014 | Nicolis | G09F 7/18 248/309.1 |
| 2021/0090471 | A1 * | 3/2021 | Kim | G09F 9/30 |

FOREIGN PATENT DOCUMENTS

| | | | |
|---|---|---|---|
| CA | 2547507 | A1 | 10/2007 |
| EP | 3035318 | A1 | 6/2016 |
| WO | WO2008141901 | A1 | 11/2008 |

* cited by examiner

*Primary Examiner* — Gary C Hoge

(74) *Attorney, Agent, or Firm* — Brouillette Legal Inc.; Robert Brouillette

(57) ABSTRACT

An electronic shelf label holder incorporating a curved upwardly extending edge at the rear of the topmost portion where debris and contaminants can accumulate. By incorporating this feature, the invention enables associates to easily and effectively wipe or clean the topmost surface without the need to actually remove the label holder, since the edge is designed to espouse the curves of a finger making wiping debris simple and effective.

17 Claims, 6 Drawing Sheets

EXTRUDED PROFILE FOR ELECTRONIC SHELF LABEL HOLDER

CROSS-REFERENCE TO RELATED APPLICATIONS

The present patent application claims the benefits of priority of U.S. Patent Application No. 63/009,48, entitled "EXTRUDED PROFILE FOR ELECTRONIC SHELF LABEL HOLDER", and filed at the United States Patent Office on Apr. 14, 2020, the content of which is incorporated herein by reference.

FIELD OF THE INVENTION

This invention relates to label holders and relates more particularly to holders for electronic devices generally mounted at the front of a merchandise shelf in a retail establishment to provide information regarding products carried by the shelf. These are called Electronic Shelf Labels (ESL). More particularly, the invention relates to the integration of ESLs to existing product label/tag infrastructures found in various retail locations while achieving specific performance criteria.

BACKGROUND OF THE INVENTION

Consumer-oriented product information labels are commonly found in supermarkets, drug stores, and the like and provide purchasers with the unit price, promotional and nutritional information, and the like and, also, commonly include bar codes or other inventory control information for the use of the store personnel. Such information may be carried on paper or plastic labels secured directly to the side of a shelf unit or the front edge of a merchandise shelf, but the use of adhesively-backed labels has obvious disadvantages in the constantly changing commercial environment found in today's marketplace. More often, the front edge of the merchandise shelf is provided with an integral C-channel or the like which is adapted to either carry the labels directly or, alternatively, to carry plastic holders which are adapted to removably receive and display the labels in a well-known manner.

More recently, in place of, or in addition to, such paper or plastic information containing labels, electronic information carriers have been employed. ESLs are generally integrated with the in-store processor (ISP) or a free-standing controller that communicates with file information supporting the store's point-of-sale system. The ESL system may include low-voltage communication electronics or communication base stations (CBS) located in store ceilings away from the store operations. The ESLs are positioned throughout the store to identify an item's retail price and other information of interest to the consumer or for use by the store's inventory system.

Price changes may be initiated through the store's controller which updates item price files. This information, which has an association to a particular product identified by item number or UPC code, is communicated to the CBS in the ceiling and transmitted via a high frequency radio signal to the corresponding ESL.

The ESLs are programmed with differing addresses that are also associated with the item number or UPC code of the product they represent. Once the addressed device is found, the label display changes and reflects an acknowledgment back to the CBS to confirm that the transmission was received and enacted. This acknowledgment is then communicated back to the ISP to complete the transaction.

These systems, allow the ESLs to be independent of wires and cables below the ceiling, which reduces installation time and cost. Since there are no wires or cables required from the ceiling down, the label is free to be positioned anywhere. When store shelf resets occur, ESLs move easily with the shelves.

These ESL units, however, much like paper labels, require a carrier device to facilitate supporting them at selected locations, usually on the front of a store merchandise shelf. It is ESL carriers of this type with which the present invention is concerned. The invention is used to replace label/tag holders which only accept paper labels or tags.

During the installation process paper tags are removed and temporarily installed in the new ESL holder via an incorporated track at the bottom of the new rail and positions the pricing in the intended location until the installation team inserts the ESL and pairs-it to the product on the shelf. Once the ESL is clipped into the rail, paired to the product and displays the intended price, the paper label can be discarded.

Retail Products are commonly stored, displayed and sold using flat and inclined shelving. These shelves are manufactured with a variety of shelf edge frontage designs used to showcase a product's pricing. To showcase pricing of a product, the shelf s edge is either used as-is or retrofitted with a common label holder. The label holder is usually attached to the shelf by compressing into the channel integrated in the metal shelving's design. For the past few decades retailers have opted to retrofit their shelves with these extruded plastic profiles (also known as data-tracks, rails, holders or strips) to accommodate paper price tags of different sizes and colors. The current colored rails are also used to define different departments, draw attention from consumers, increase the edge size of the shelf to accept larger paper price tags and to renew the cosmetic appeal of the shelf via regular data-track replacements.

However, using ESLs versus printed media to showcase pricing and information regarding the product has become a more sustainable, efficient, attractive and more cost-efficient solution when compared to paper media.

An in-depth study and proper due diligence was performed at countless retail locations across multiple retail store brands to properly study and understand the impacts on the retail chain when migrating to ESL technology while retaining store layout and existing infrastructures.

While a number of existing label holders do their job of actually holding the ESL, when the shelving needs to be cleaned some holders need to be removed to allow accumulated debris and contaminants (dust, sugar, flour, liquids, milk, etc. . . . ) to be properly cleaned away.

OBJECTS OF THE INVENTION

One of the purposes of the invention is to allow various models of ESLs to be attached to various models of existing shelving and displays found in most retail outlets.

Another object of the invention is to facilitate the removal contaminants generated by the goods being sold (flour, milk, juice, etc. . . . ).

The invention takes into consideration the realities of retail locations in regards to high traffic, viewing angle of the information, premature aging of the current rails, product placement, safety towards consumers, application environments (hot&cold), augmented performance and lifespan, tamper proofing and universality of integration.

SUMMARY OF THE INVENTION

The aforesaid and other objectives of the present invention are realized by generally providing the same frontage to accept the ESLs and various retention design at the rear of the profile to offer the same sanitation characteristics in all departments of the retail location. Some areas require a flat back with adhesive for glass, wood or wall application while other require attachment onto metal wire displays, c-channel rails, flat metal plate hooks, custom freezer shelving, etc. . . . .

The invention achieves these results by incorporating a curved upwardly extending edge at the rear of the topmost portion where debris and contaminants can accumulate. By incorporating this feature, we enable the associates to easily and effectively wipe or clean the topmost surface without the need to actually remove the label holder, since the radius is designed to espouse the curves of a finger making wiping debris simple and effective. By maintaining the front design of the invention, rear attachment systems can be varied to fit onto multiple surfaces as seen here by either clipping or adhering to surfaces. This invention meets the requirements of the ESL manufacturers by accepting various sizes and models of tags required to be viewed at specific angle ranges. The invention also meets many anti-tamper criteria and fixed positioning (once installed) by ensuring the tags stay aligned with the intended goods and prevent unauthorized movement of the tags that can result in mislabelling of merchandise by associates or consumers.

The invention circumvents the need to have perforated label holders for tags with locking pins (a feature incorporated into many ESLs) and it also facilitates removal or repositioning of the tags without the need for standard or specialty tools.

No other device destined for this application also complies with the requirements of the National Sanitation Foundation (NSF) as this invention does. This invention is the first of its kind to have incorporated a curved upwardly extending edge at the rear of the topmost portion which we call Radius Shaped Transition™ onto the shelf to prevent the collection of debris and contaminants between itself and the shelf edge. The surface finish is preferably completely free of porosity to prevent colonisation of bacteria and is preferably manufactured using an anti-bacterial polymer blend.

The invention is preferably manufactured with a proprietary chemical composition, developed through multiple trials and research in regards to stress testing, accelerated aging, impact resistance, etc. . . . . The result of which yielded a molecularly stable engineered blend of polymers which can be reliably processed via extrusion. The preferable use of non-toxic Restriction of Hazardous Substances (ROHS) Directive compliant chemical additives ensures the engineered blend of polymers meets safety guidelines for consumer environments and food contact, UV stability criteria (preventing the color fading or yellowing and deterioration of the resin compound), anti-fungal aspects (when used in wet or humid environments), impact resistance (for maximized lifespan).

Other and further objects and advantages of the present invention will be obvious upon an understanding of the illustrative embodiments about to be described or will be indicated in the appended claims, and various advantages not referred to herein will occur to one skilled in the art upon employment of the invention in practice.

Main aspects of the invention consider the installation technique and time allocated for the retrofit. The rails must be easy to install while offering solid retention onto the shelving in order to accommodate for the forces applied when removing the ESLs from the holder. This is achieved by maintaining the proper shape at the back of the holder as well as the proper material blend and thickness. It must also offer a temporary area to affix paper labels as well as an innovative design to accommodate the presence (or lack of) locking pins.

The features of the present invention which are believed to be novel are set forth with particularity in the appended claims. The single most exclusive feature being it's conformity to NSF requirements for cleanliness achieved by it's radius top filleted towards the surface of the shelf or fixture and allowing a finger to swipe across the top and removing 98% more contaminants than all other designs of ESL holders.

BRIEF DESCRIPTION OF THE DRAWINGS

The above and other objects, features and advantages of the invention will become more readily apparent from the following description, reference being made to the accompanying drawings in which.

DETAILED DESCRIPTION OF A PREFERRED EMBODIMENT

A novel ESL holder profile will be described hereinafter. Although the invention is described in terms of specific illustrative embodiment(s), it is to be understood that the embodiment(s) described herein are by way of example only and that the scope of the invention is not intended to be limited thereby.

Figure 1:
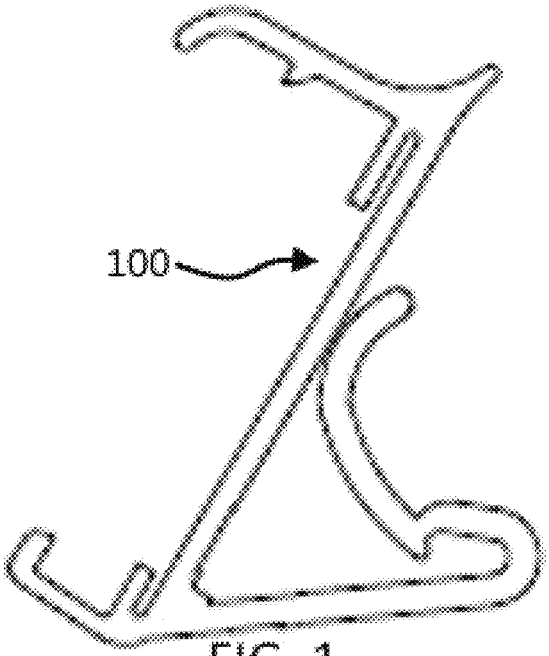
FIG. 1 is a side view of an embodiment of the invention wherein the extruded profile is a clip-on model for Madix™ shelves.

An embodiment of the invention is seen in FIG. 1 wherein the extruded profile is a clip-on model 100. The clip-on model 100 is to be generally installed on a shelf with a downward face at its outermost portion. As such, the clip-on model may not need any adhesive or fastener to be secured on a shelf and may therefore be easier and faster to install and uninstall then other installation options.

Figure 2:
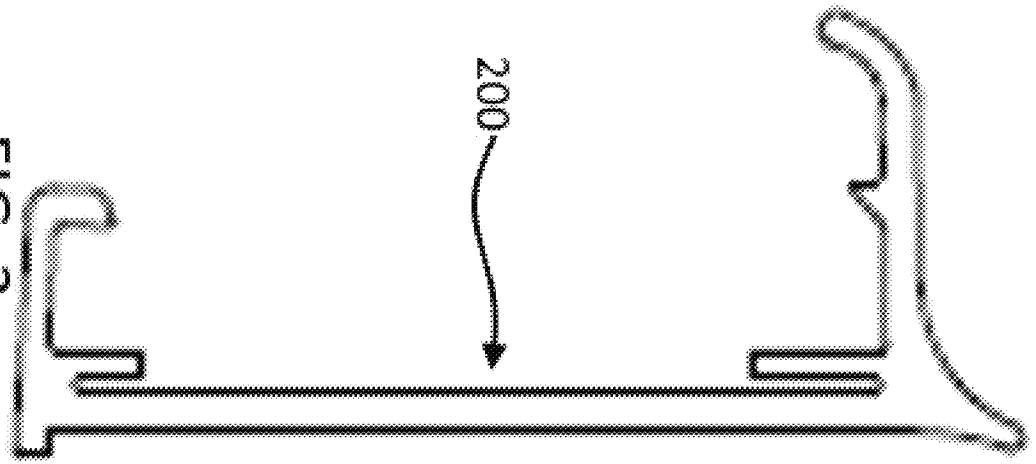
FIG. 2 is a side view of an embodiment of the invention wherein the extruded profile is attached to the shelve using an adhesive.

Another embodiment is shown in FIG. 2 in which the extruded profile is an adhesive model 200. The adhesive model 200 may be suited to any shelf having a generally flat surface at its furthermost portion. This extruded profile model may generally be installed on the same shelves than the clip-on model 100, but it may further be installed on shelf types having parts obstructing the access behind the relatively flat surface wherein a clip may not go.

Figure 3:
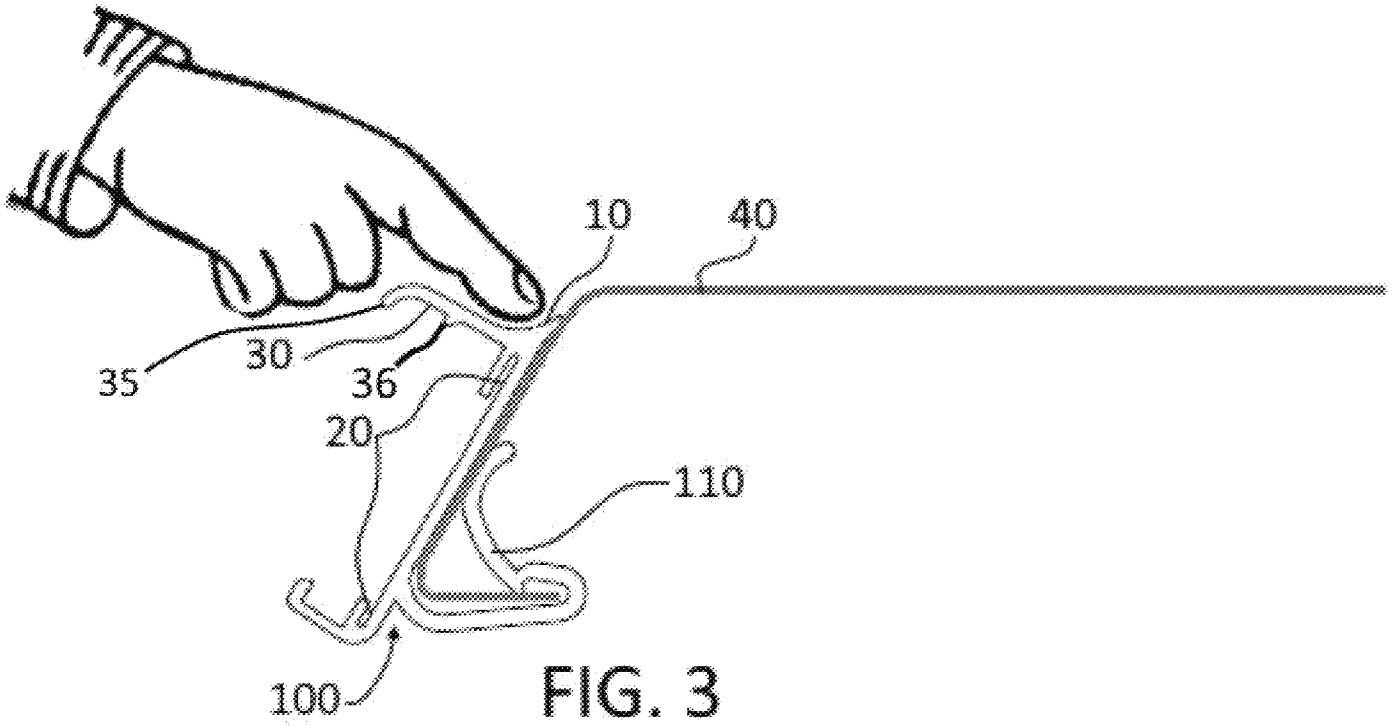
FIG. 3 is a side view of the embodiment of FIG. 1 wherein the extruded profile is installed on a shelf.

Now referring to FIG. 3, the clip-on model of FIG. 1 is installed on a shelf 40. The shelf 40 for a clip-on model 100 generally has a flat surface going downwards from the outermost portion of the shelf and a smaller horizontal surface going inwards of the shelf starting from the bottom of the flat downward surface. The back surface of the model 100 is to be generally flat so that it may lay on the shelf surface with no free space. Any free space between the back of the clip-on model and the shelf surface may allow the accumulation of unwanted particles such as debris, bacteria and humidity which is to be avoided. Having no space behind the clip-on model 100, unwanted particles may instead accumulate on the top portion of the same. A curved upwardly extending edge 10 is provided at the rear of the top portion. As illustrated in FIG. 3, this curved portion preferably has a radius generally corresponding to the tip of the index finger of the person who will be cleaning the profile. This radius is usually in the range of 4 to 10 mm. The profile should be manufactured to comply with the requirements of the NFS. The curved edge 10 is manufactured so that no unwanted particle is unreachable when the profile is cleaned or wiped. More precisely, any unwanted particle may be wiped with a finger on the curved edge 10.

In order to be installed on a shelf, the model 100 further comprises a retention clip 110. The retention clip 110 in the embodiment shown has a shape which may cover the bottom and the downward surfaces of the shelf 40. The clip 110 may further have any shape and size which may secure a clip-on model 100 on a shelf. In order to accommodate paper labels, the model 100 may further comprise paper label accommodations 20 of any shape and size known in the art. In the embodiment of FIGS. 1 and 3, such accommodations 20 may be presented as small strips protruding from the top and bottom sections of the model 100. The label strips 20 are sized to receive the respective top and bottom portions of a label. The label strips 20 proportions are manufactured so that the majority of commercially available paper labels may have the majority of the printed information readable when properly installed.

In some cases, ESLs may be installed in label holders in lieu of paper labels. ESL devices may have locking pins to be secured to those label holders. Consequently, the invention may have locking pin accommodations 30 of any shape or size known in the art to accommodate locking pins of the sort. In the presented embodiment, such accommodations 30 may be presented as a strip protruding vertically and away from the topmost portion of the profile 100. The strip 30 comprises two notches 35, 36 going inwards of the profile 100, one at the end and one at the beginning of the strip 30. Such notches 35, 36 may help secure a locking pin in place. Unlike other ESL holders known in the art, accommodations of the kind do not require drilling sections of a shelf to secure the ESLs into place.

Figure 4:
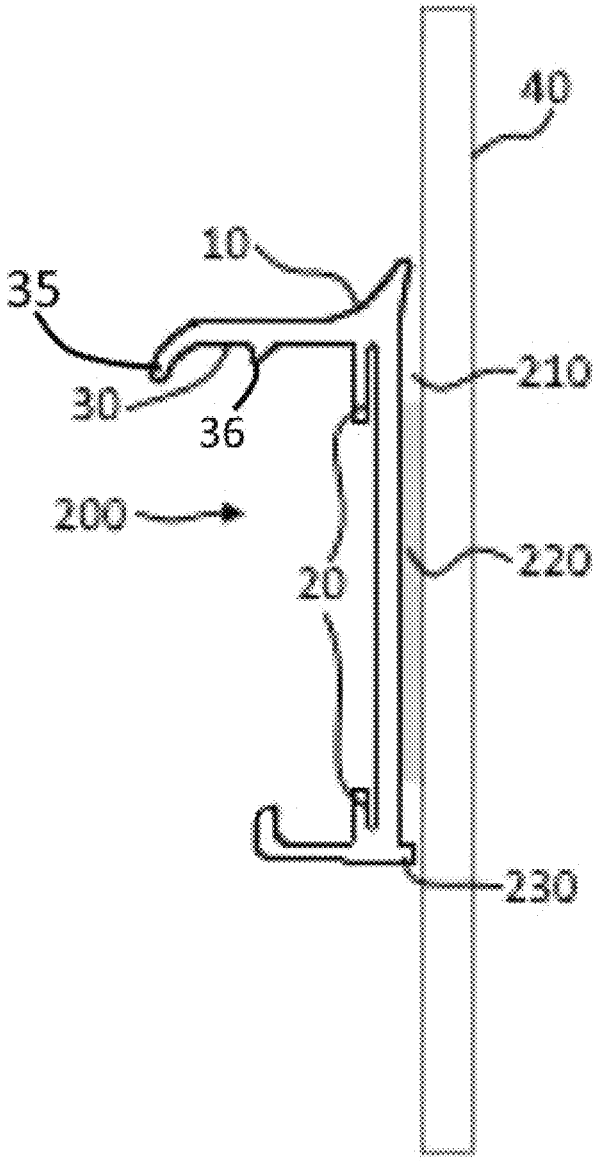
FIG. 4 is a side view of the embodiment of FIG. 2 wherein the extruded profile is installed on a shelf using an adhesive.

FIG. 4 shows an embodiment of an extruded profile 200 made to be coupled with an adhesive for its installation. The adhesive profile 200 may comprise the same label holding mechanisms than the clip-on profile 100. Both models may mainly vary in regards to their fastening mechanism to the shelf 40. In that regard and contrary to the first model embodiment, there may be space between the back surface of the adhesive profile 200 and the flat surface of a shelf 40. The space 210 may allow the insertion of an adhesive 220, such as an adhesive strip with adhesive on both its surfaces. To avoid the accumulation of unwanted particles behind the profile 200, the top portion of the curved edge 10 may be manufactured to protrude towards the flat surface of the shelf 40 so that it may be in contact and may block the passage of the above-mentioned particles. To further stabilize the adhesive profile 200, a stabilizing flange 230 may be positioned on the back of the same and protruding towards the shelf 40.

Figure 5:
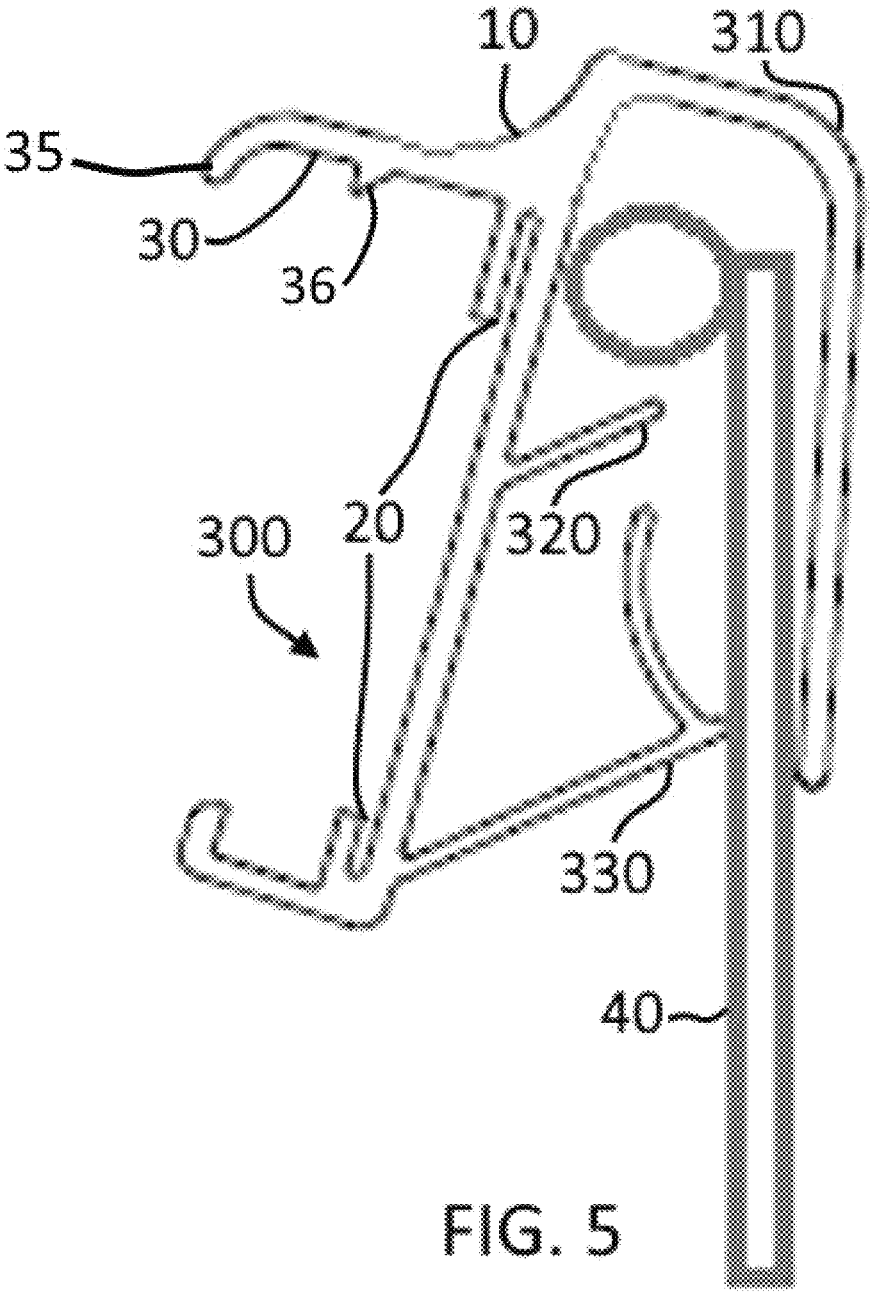
FIG. 5 is a side view of an embodiment of the invention wherein the extruded profile is installed on a single wire shelf.
Figure 6:
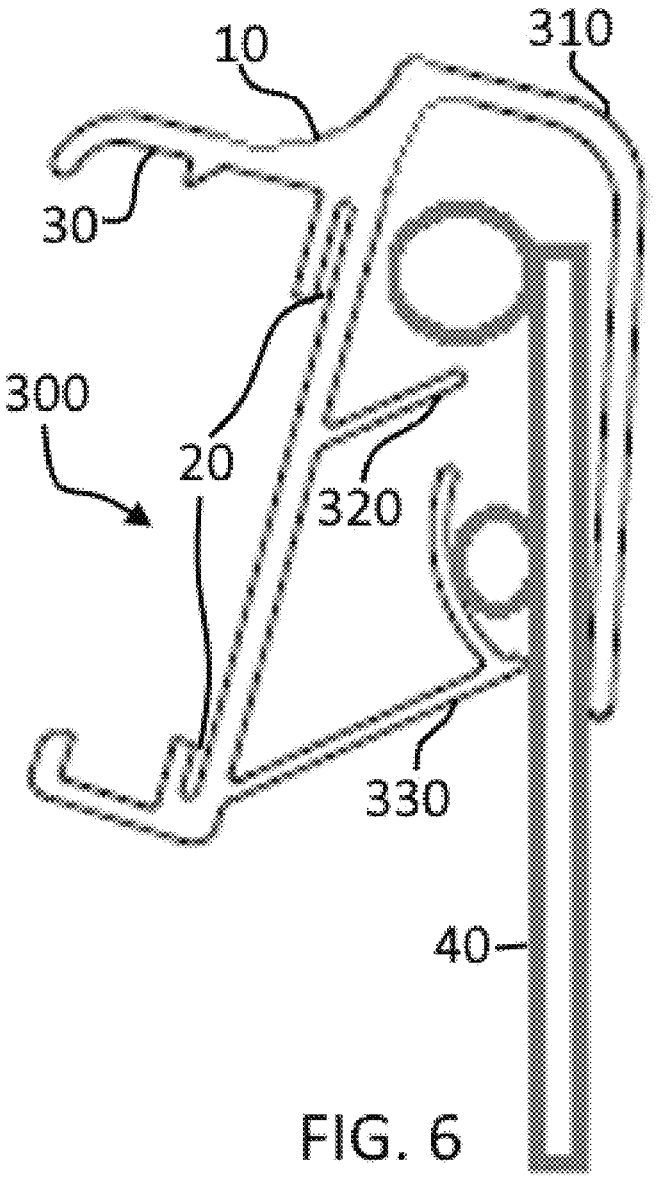
FIG. 6 is a side view of an embodiment of the invention wherein the extruded profile is installed on a double wire shelf.

Shown on FIGS. 5 & 6 are extruded profiles made to be installed on wire shelves 40. This embodiment may be installed on single wire shelves 40, as seen on FIG. 5, and on double wire shelves 40 as seen on FIG. 6. The wire shelf profile 300 may comprise the same label holding mechanisms as the clip-on 100 profile and adhesive profile 200, but may differ from those same models in regard to its shelf securing mechanism. As such, the wire shelf profile 300 may comprise a plurality of tabs allowing a secure fit to a shelf and its wires. The number of tabs may vary and their shape and size may also vary as to fit to different types of wire shelves. In the embodiment of FIGS. 5 & 6, the profile 300 comprises three tabs. A first tab 310, protruding from the top portion of the curved edge 10, is manufactured to apply pressure to the back surface of the shelf 40 while simultaneously protecting the back section of the profile 300 against the entry of unwanted particles from the top. A second tab 320, protruding from the middle section of the back of the profile 300, is manufactured to possibly enter in contact against a wire of the shelf 40. It may prevent the wire shelf model 300 from falling to the ground would the other tabs start sliding off from the shelf 40. A third tab 330, protruding from the bottom section of the profile 300, is manufactured to apply pressure to the forward bottom face of the shelf 40. There is an additional portion protruding from the part in contact with the shelf that may add further stabilization would a second wire be on the shelf in this zone. This portion may go upwards or downwards, depending on the position of the second wire.

Any embodiment of the present invention, such as the clip-on profile 100, adhesive profile 200 and shelf wire profile 300 may be made of any material known in the art, but is to be generally made of a rigid material with an elastic modulus allowing a slight deformation to install and uninstall the invention without having to apply too much force and without risk of breaking it. The material may further be a blend of polymers and may contain non-toxic chemicals that are ROHS compliant comprising, for example, UV stability properties, anti-fungal aspects and a resistance to everyday use impacts. Moreover, the invention may be covered by a surface finish so that it may be completely free of porosity, which may also prevent the accumulation of bacteria. The surface finish may further be manufactured using an anti-bacterial polymer blend for added hygiene and longevity. Because the invention may be used in environments having a low ambient temperature, such as in freezers or fridges, it is also important that the invention be resistant to low temperatures and that it may retain its characteristics and performance as mentioned above in most commercial applications.

While illustrative and presently preferred embodiment(s) of the invention have been described in detail hereinabove, it is to be understood that the inventive concepts may be otherwise variously embodied and employed and that the appended claims are intended to be construed to include such variations except insofar as limited by the prior art.

The invention claimed is:

1. An electronic shelf label holder for securing an electronic shelf label to a shelf, the electronic shelf label holder comprising:

a support portion comprising an elongated member adapted to secure the electronic shelf label holder to the shelf; and a gripping portion integral with the support portion, the gripping portion comprising at least one channel configured to receive a paper label and a locking mechanism configured to receive the electronic shelf label;

wherein the gripping portion extends from an upper portion of the support portion defining a curved upwardly extending edge and the curved upwardly extending edge extends to contact the shelf when the electronic shelf label holder is secured to the shelf.

2. The electronic shelf label holder of claim 1, wherein the curved upwardly extending edge comprises a radius of curvature between 4 mm and 10 mm.

3. The electronic shelf label holder of claim 1, wherein the support portion comprises a connector.

4. The electronic shelf label holder of claim 3, wherein the connector comprises a recess for receiving a lip of the shelf.

5. The electronic shelf label holder of claim 4, wherein the connector further comprises a resilient arcuate member adapted to press against a first surface of the shelf and a second surface of the shelf.

6. The electronic shelf label holder of claim 3, wherein the connector comprises a first member extending from the upper portion of the support portion in a substantially downwardly direction and adapted to receive a first wire of the shelf.

7. The electronic shelf label holder of claim 6, wherein the connector further comprises a second member extending from a lower portion of the support portion and towards the first member and adapted to receive a second wire of the shelf.

8. The electronic shelf label holder of claim 1, wherein the support portion comprises an adhesive for securing the electronic shelf label holder to the shelf.

9. The electronic shelf label holder of claim 1 further comprising two channels configured to receive the paper label, the channels being parallel and extending opposite each other.

10. The electronic shelf label holder of claim 1 further comprising a non-porous polymer material.

11. The electronic shelf label holder of claim 1, wherein the locking mechanism comprises a notch adapted to receive a locking pin of the electronic shelf label.

12. A method of securing an electronic shelf label to a shelf, the method comprising the steps of:

securing an electronic shelf label holder to the shelf;

securing the electronic shelf label to a gripping portion of the electronic shelf label holder, the gripping portion extending from an upper portion of the electronic shelf label holder and defining a curved upwardly extending edge.

13. The method of claim 12, wherein securing the electronic shelf label holder to the shelf comprises using an adhesive.

14. The method of claim 12, wherein securing the electronic shelf label holder to the shelf comprises pressing a resilient arcuate member against a first surface of the shelf and a second surface of the shelf.

15. The method of claim 12, wherein securing the electronic shelf label to the gripping portion of the electronic shelf label holder comprises inserting a locking pin of the electronic shelf label into a notch of the electronic shelf label holder.

16. The method of claim 12 further comprising securing a paper label to the electronic shelf label holder.

17. The method of claim 16 further comprising inserting at least one side of the paper label into at least one channel of the gripping portion.

* * * * *